US006200070B1

(12) United States Patent
Knight

(10) Patent No.: US 6,200,070 B1
(45) Date of Patent: Mar. 13, 2001

(54) PROCESS OF INSTALLING PILES FOR SUPPORTING A STRUCTURE UPON THE EARTH

(76) Inventor: David W. Knight, P.O. Box 2586, Humble, TX (US) 77347

( * ) Notice: Subject to any disclaimer, the term of this patent is extended or adjusted under 35 U.S.C. 154(b) by 0 days.

(21) Appl. No.: 09/503,455

(22) Filed: Feb. 14, 2000

(51) Int. Cl.[7] ..... E02D 5/30

(52) U.S. Cl. ..... 405/232; 405/229; 405/230; 405/251

(58) Field of Search ..... 405/229, 230, 405/232, 251

(56) References Cited

U.S. PATENT DOCUMENTS

| | | | | |
|---|---|---|---|---|
| 3,326,006 | | 6/1967 | Mount . | |
| 3,487,646 | | 1/1970 | Gatien . | |
| 3,555,833 | | 1/1971 | Correa . | |
| 3,630,037 | | 12/1971 | Howard . | |
| 3,703,812 | | 11/1972 | Newton . | |
| 3,851,483 | | 12/1974 | Holley, Jr. . | |
| 3,899,891 | * | 8/1975 | Kelly et al. | 405/251 |
| 4,431,347 | * | 2/1984 | Gillen, Jr. | 405/251 |
| 4,838,737 | | 6/1989 | Quimby . | |
| 4,915,544 | | 4/1990 | Lin . | |
| 5,108,227 | | 4/1992 | Bergey . | |
| 5,228,807 | | 7/1993 | Willcox, Jr. . | |
| 5,288,175 | | 2/1994 | Knight . | |
| 5,399,055 | * | 3/1995 | Dutton, Jr. | 405/230 |
| 5,551,804 | * | 9/1996 | Breaux et al. | 405/232 |
| 5,669,736 | | 9/1997 | Lin . | |
| 5,713,701 | | 2/1998 | Marshall . | |

FOREIGN PATENT DOCUMENTS

| | | | | |
|---|---|---|---|---|
| 8702268 | * | 4/1989 | (NL) | 405/251 |

* cited by examiner

*Primary Examiner*—Eileen D. Lillis
*Assistant Examiner*—Alexandra K. Pechhold
(74) *Attorney, Agent, or Firm*—Harrison & Egbert

(57) ABSTRACT

A process of installing piles for supporting a structure upon the earth including the steps of forming a receptacle in a first pile segment, affixing an end of a strand into the receptacle such that the strand extends outwardly from the first pile segment, sliding a second pile segment onto the strand until the second pile segment contacts a surface of the first pile segment, and driving the second pile segment a desired distance into the earth. The receptacle is formed in the first pile segment while the first pile segment is in the earth. The step of affixing an end ofthe strand includes the steps of introducing a structural adhesive into a hole formed in the first pile segment, introducing an end of the strand into the hole such that the adhesive contacts the strand and the pile segment, and solidifying the adhesive around the end of the strand such that the end of the strand is rigidly and non-removably secured within the hole in the pile segment.

17 Claims, 2 Drawing Sheets

PROCESS OF INSTALLING PILES FOR SUPPORTING A STRUCTURE UPON THE EARTH

TECHNICAL FIELD

The invention relates to the repair of building foundations by underpinning. More specifically, it relates to a method for aligning pile segments during installation, inspecting pile penetration depth, and continuously reinforcing an improved segmental precast concrete pile used for underpinning repairs.

BACKGROUND ART

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur, (b) independent inspection of the installed pile depth is only possible by providing full-time inspection personnel during installation to monitor the quantity of pile segments used at each pile location, and (c) the complete pile is an unreinforced stack of precast concrete segments.

Misalignment of the segments as they are installed can produce several conditions detrimental to the future pile stability. Lack of proper independent inspection of pile depth can lead to inadequate pile penetration, which in highly expansive soils produces an unstable installation subject to continued movements caused by seasonal change in soil moisture. An unreinforced or non-continuously reinforced pile is subject to permanent separation at segment joints or breakage at segment midpoints when installed in clay soils having high shrink-swell potentials.

Under certain circumstances, the under-consolidated soil conditions into which pile segments are installed can have a "chicken pot pie" configuration. In other words, the surface of the earth is a stiff crust which is supported upon a softer layer which is, in turn, supported upon a denser layer. In the past, it has been the practice in certain areas of the country, such as the Louisiana area, to insert timber piles into such types of earth. These timber piles can have a length of thirty feet or more which would be intended to extend through the softer layer so as to be supported upon the lower denser layer of such soil configurations. Unfortunately, such timber piles sometimes have inadequate lengths for extending entirely through the softer layer. If the bottom end of the timber piles fail to contact the lower denser layer of the earth, the timber pile can subsequently sink through the softer layer. As a result, the building foundation can excessively settle with the supported structure thereon.

In the past, various patents have issued relating to the devices for installing underpinning piles retroactively for the support of a structure. For example, U.S. Pat. No. 5,288,175, issued on Feb. 22, 1994, to D. W. Knight, describes a continuously reinforced segmental precast concrete underpinning pile which uses a method of installing where a high strength strand aligns the precast segments during installation. The strand provides a means for measurement of the pile penetration depth. The strand continuously reinforces the pile when bonded or anchored upon completion. This patent describes a further process whereby a strand is affixed to a first pile segment prior to being driven into the earth. The first pile segment, along with the attached strand, is driven a desired distance into the earth from the supporting structure. The strand will extend outwardly from an end of the first pile segment. The second pile segment then slides along the strand until the second pile segment contacts an end of the first pile segment. The second pile segment is then driven into the earth for a desired distance. Ultimately, after each of the pile segments is driven a desired distance into the earth, a cap member is affixed to the top of the array of pile segments so as to be placed in proximity under the foundation of the structure. In the "chicken pot pie" type soil conditions, the method of this patent fails to utilize existing pile structures. As such, there is a considerable cost associated with the driving of multiple piles segments through the softer layer of the earth. Under such soil structures, it would be desirable to use the existing pile structures if possible.

U.S. Pat. No. 5,399,055, issued on Mar. 25, 1995, to E. T. Dutton, Jr., teaches a device and method to level and repair a failed concrete foundation. A series of cylindrical pile segments are jacked into the soil with water jetting to a pre-determined depth. This is used so as to attain sufficient skin friction. Reinforcing steel is inserted into the stacked column of cylindrical pile segments and grout is further pumped into the cylindrical pile segments to suitably fix the reinforcing steel to the inside ofthe cylindrical piles. This forms a single shaft pile so as to eliminate or reduce pile deflection and sheer. Once again, the patent fails to make use of existing timber piles.

It is an object of the present invention to provide a method of installing pile segments for supporting a structure upon the earth.

It is another object of the present invention to provide a method of installing pile segments which makes use of existing timber piles below the structure.

It is another object of the present invention to provide a method of installing pile segments which minimizes the number of pile segments required for the support of the building.

It is a further object of the present invention to provide a method of installing pile segments which more suitably supports a structure on a "chicken pot pie" type earth structure.

These and other objects and advantages of the present invention will become apparent from a reading of the attached specification and appended claims.

SUMMARY OF THE INVENTION

The present invention process of installing piles for supporting a structure upon the earth comprising the steps of: (1) forming a receptacle in an existing first pile segment; (2) affixing an end of a strand into the receptacle such that the strand extends outwardly from the first pile segment; (3) sliding a second pile segment onto the strand until the second pile segment contacts a surface of the first pile segment; and (4) driving the second pile segment a desired distance into the earth.

In the present invention, the first pile segment has been installed into the earth prior to the installation of the receptacle in the first pile segment. The step of forming a receptacle comprises forming the receptacle while the first pile segment is located in the earth.

In the preferred embodiment of the present invention, the first pile segment is a timber pile. The step of forming a receptacle comprises drilling a hole into an end of the timber pile for a desired distance. This hole typically extends for at least two feet into the timber pile or to a depth suitable for fully anchoring a strand. The step of affixing comprises the steps of: (1) introducing a structural adhesive into the hole; (2) inserting an end of the strand into the hole such that the adhesive intimately contacts the strand and the timber pile; and (3) solidifying the adhesive around the end of the strand such that the end of the strand is rigidly and non-removably secured within the hole of the timber pile. The adhesive, in the preferred embodiment of the present invention, is a structural epoxy compound.

The method of the present invention further includes the step of forming a hole extending longitudinally through the second pile segment. The second pile segment is threaded along the strand prior to the step of sliding. The step of sliding comprises moving the second pile segment along the strand until the second pile segment is vertically aligned with the first pile segment. The second pile segment has an end surface in surface-to-surface contact with the top end of the first pile segment.

In the present invention, a volume of earth can be removed from beneath a portion of the structure so as to expose the first pile segment. The first pile segment will extend below this portion of the structure. A section at the top of the first pile segment may be physically removed prior to forming a receptacle for receiving the strand. A jack is placed between the pile segment and the portion of the structure, and the pile segment is driven into the earth a desired distance.

A bending template is interposed between the end of the pile segment and the jack. The bending template serves to angularly deflect the strand from the jack to prevent damage. The strand may be marked with indicators corresponding to a length of measurement.

In the present invention, a cap member is positioned between a portion of the structure and the final pile segment. The strand is trimmed following positioning and anchoring of the cap member. The strand may be tensioned prior to the step of anchoring.

DETAILED DESCRIPTION OF THE INVENTION

Figure 1:
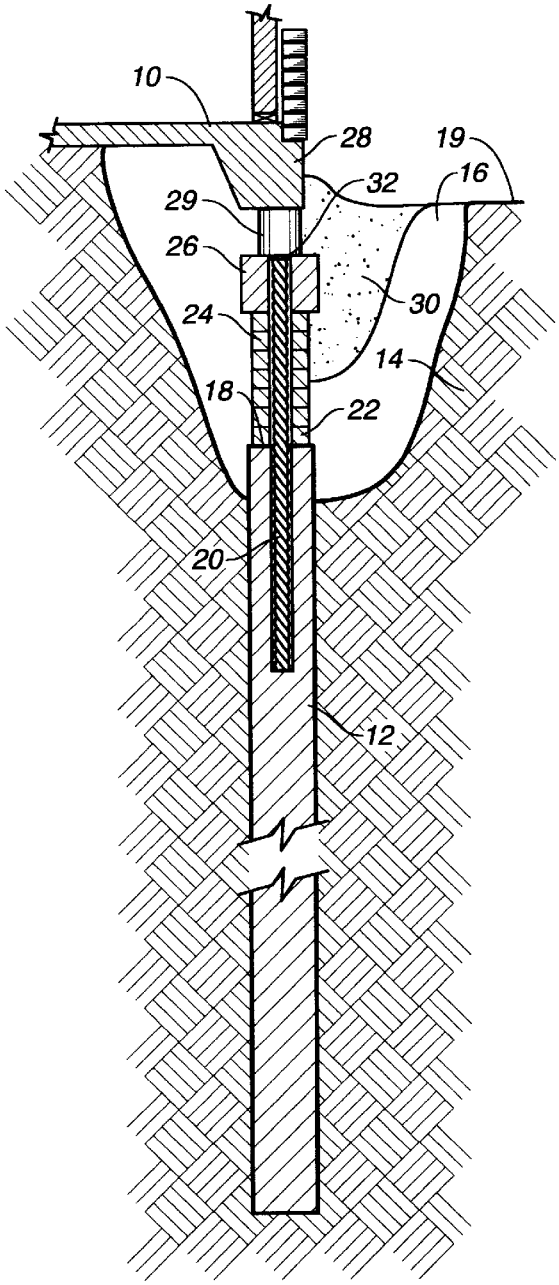
FIG. 1 is an illustration showing the completed method of the present invention for the support of a building structure.

Referring to FIG. 1, there is shown the completed process of the installation of piles for supporting a structure 10 above the earth. In FIG. 1, it can be seen that a timber pile 12 extends deeply into the earth 14. An excavation 16 is carried out below the surface 19 of the earth 14. This excavation 16 serves to expose the top end 18 of the timber pile 12.

Within the concept of the present invention, a strand 20 is secured into the top end 18 of the timber pile 12. Strand 20 will extend upwardly through the interior of the second pile segment 22, through a plurality of other pile segments 24, and will be secured to a cap member 26. Cap member 26 is positioned so as to be placed directly below the bottom of the building structure 10 so as to properly support in a desired position the foundation 28 of building structure 10 utilizing support shims 29. The excavation 16 can be filled in with a filler material 30 so as to close the excavation 16 and to enclose the pile segments 22 and 24, along with the cap member 26 and the support shims 29, within the earth 14.

In FIG. 1, the strand 20 has one end secured within the interior of the timber pile 12. The strand member 20 will extend through a hole formed into and through each of the pile segments 22 and 24. Suitable cement or grout material can be used so as to fill the spaces between the strand 20 and the walls of the holes of each of the pile segments 22 and 24. The upper end 32 of strand 20 can be suitably tensioned and secured, in anchored relation, to the cap member 26, or within any of the pile segments 24.

Figure 2:
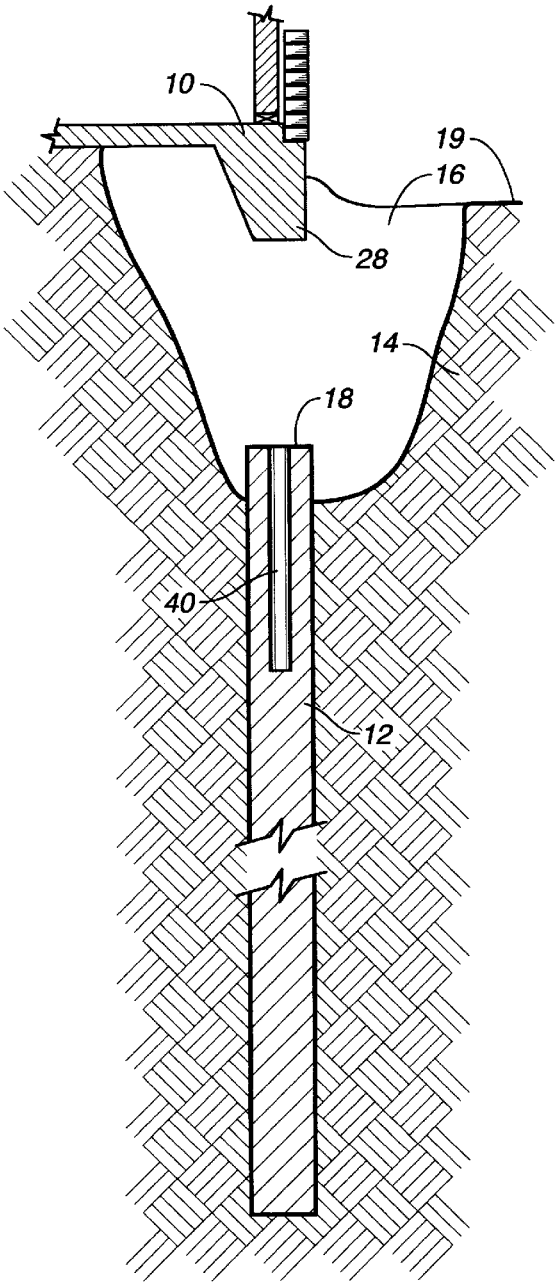
FIG. 2 shows a first step in the method of the present invention.

The first step of the method of the present invention is illustrated in FIG. 2. Initially, excavation 16 is carried out in earth 14 so as to expose the upper portion of timber pile 12 and to form the top end 18 of the timber pile 12. Typically, the top end 18 of the timber pile 12 will be located approximately two feet below the surface 19 of the earth 14. In normal practice, the timber pile 12 has been used so as to support the structure 10. The excavation 16 is used so as to expose the upper portion of timber pile 12 and to form the top end 18 of timber pile 12 and the space between top end 18 and the bottom of foundation 28.

The next step in the method of the present invention is simply to drill a hole 40 into the top end 18 of timber pile 12 and downwardly through the timber pile 12 for a desired distance. In the preferred embodiment of the present invention, the hole 40 should be drilled for at least two feet or a distance sufficient to adequately anchor the strand. In the position shown in FIG. 2, the hole 40 will be in a proper position for the receipt of the strand 20 therein.

Figure 3:
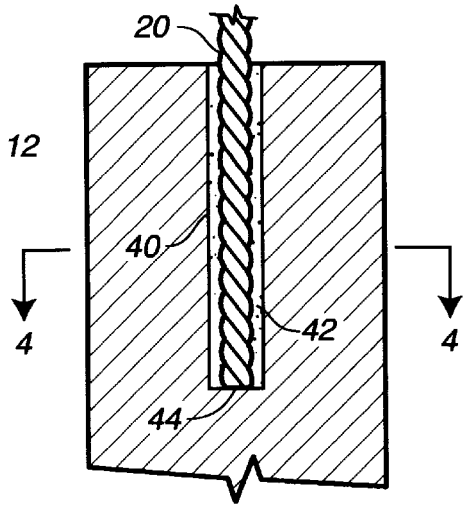
FIG. 3 shows a second step in the method of the present invention illustrating with particularity, the securing of the strand within a top of the timber pile.

FIG. 3 shows the manner in which the strand 20 can be installed within the hole 40 of the timber pile 12. Initially, an adhesive, or grout material 42 is introduced into the hole 40. Preferably, the adhesive 42 will be an epoxy compound. The end 44 of strand 20 is then inserted into hole 40 such that the adhesive 42 will intimately contact the strand 20 and the wall of hole 40 of timber pile 12. Upon solidifying, the adhesive 42 will securely and non-removably bond and anchor the end 44 of strand 20 within the hole 40. Preferably, the adhesive 42 will bond the end 44 of strand 20 within hole 40 to resist up to 15,000 pounds of tension.

Figure 4:
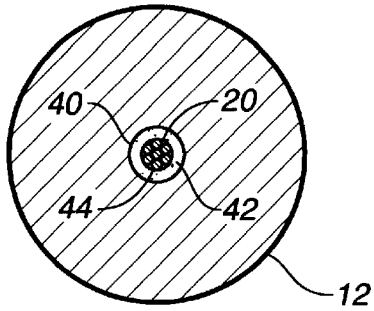
FIG. 4 is a cross-sectional view taken across lines 4—4 of FIG. 3.

FIG. 4 further shows the installation of the strand 20 within the hole 40 of the timber pile 12. The hole 40 has a circular cross section. The strand 20 has its end 44 installed centrally within hole 40. The adhesive 42 bonds the surfaces of the end 44 of strand 20 to the surface of the wall of hole 40 of timber pile 12.

Figure 5:
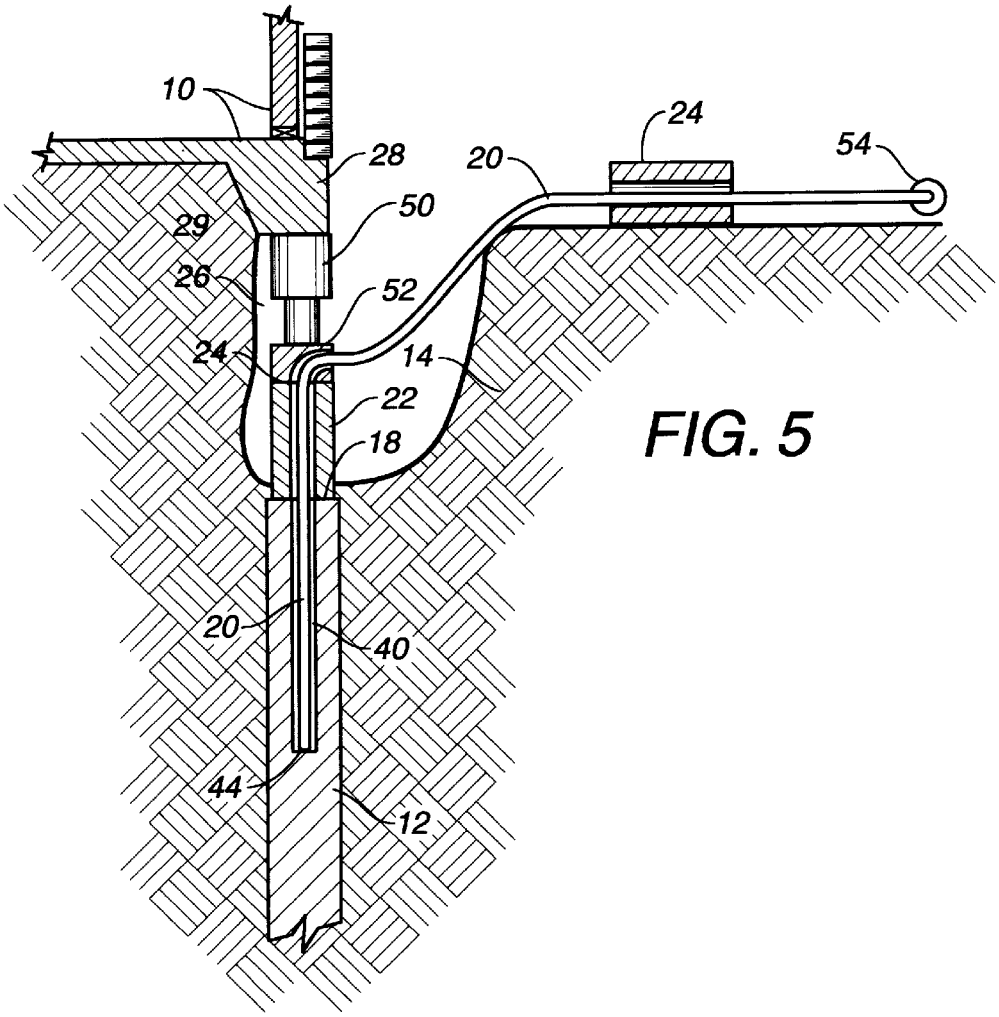
FIG. 5 is a cross-sectional view showing the procedure for the installation of the pile segments for the support of the building structure.

FIG. 5 further shows how the process of the present invention is used for the installation of the pile segments 22 and 24. In FIG. 5, it can be seen that the pile segment 22 has been placed onto the top of timber pile 12. The strand 20 has its end 44 bonded within hole 40 in the timber pile 12. The second pile segment 22 (the timber pile 12 being the first pile segment) slides along the strand 20 so as to be positioned with one end of the second pile segment 22 abutting the top end 18 of the timber pile 12. A hydraulic jack 50 serves to press the pile segment 22, along with timber pile 12, into the earth 14. A bending template 52 is positioned-between the hydraulic jack 50 and the pile segment 22 so as to bend and protect the strand 20 from damage. Strand 20 can have suitable graduated markings 54 thereon, along its length, so as to indicate a depth of which the pile segments 22 and 24 are installed. Multiple pile segments 24 are sequentially threaded onto the strand 20 for installation. The depth of additional pile penetration can be inspected by reading the strand markings 54 at the point of installation or may be calculated by measuring the length of strand remaining from the tip marker and subtracting the length from the calibrated strand length.

In normal operation, the hydraulic jack 50 will serve to press the timber pile 12 and the pile segment 22 a desired distance into the earth. After the timber pile 12 and the pile segment 22 have been pushed a desired distance into the earth 14, another pile segment 24 can then be placed onto the top surface of the pile segment 22. The action with the hydraulic jack 50 can then be repeated so that additional pile segments 24 can further be placed in an end-to-end relationship. Finally, upon completion of the operation, a cap member 26 can be placed onto the end of the strand 20. The strand 20 can then be suitably tensioned or secured within the cap member 26. The cap member 26 will engage the bottom of the foundation 28 by utilizing support shims 29 so as to adequately level and support the structure 10 in its desired position upon the earth. The number of pile segments 24 depend upon the depth of penetration of the timber pile 12 along with the intervening pile segments 22 and 24. As stated previously, the timber piles 12 are often used in deep under-consolidated soil conditions. As such, although the timber pile 12 can have a length of up to thirty feet or more, the softer layer through which the timber pile passes can be eighty feet or more. The continued placing of the pile segments 24 will continue until the bottom the timber pile 12 abuts the lower denser portion of the earth. When the bottom of the timber pile encounters adequate structural support, the capping of the pile segments and leveling and supporting of the structure can be carried out.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A process of installing piles for supporting a structure upon the earth comprising:

drilling a hole in an end of a timber pile for a desired distance while said timber pile is positioned in the earth;

affixing an end of a strand into said hole such that said strand extends outwardly from said timber pile;

sliding a pile segment onto said strand until said pile segment contacts a surface at an end of said timber pile; and driving said pile segment a desired distance into the earth.

2. The process of claim 1, wherein the desired distance is at least two feet.

3. The process of claim 1, said step of affixing an end comprising:

introducing a structural adhesive into said hole;

inserting an end of said strand into said hole such that said adhesive intimately contacts said strand in said timber pile; and solidifying said adhesive around said end of said strand such that said end of said strand is rigidly and non-removably secured within said hole.

4. The process of claim 3, said adhesive being an epoxy compound.

5. The process of claim 1, further comprising the steps of:

forming a hole extending longitudinally through said pile segment; and threading said pile segment onto said strand prior to the step of sliding.

6. The process of claim 1, said step of sliding comprising:

moving said pile segment along said strand until said pile segment is vertically aligned with said timber pile, said pile segment having an end surface in surface-to-surface contact with said end of said timber pile.

7. The process of claim 1, further comprising the steps of:

removing a volume of earth from beneath a portion of the structure, said timber pile extending below said portion of said structure; and placing a jack between said pile segment and said portion of said structure.

8. The process of claim 7, further comprising the step of:

interposing a bending template between said end of said pile segment and said jack, said bending template for angularly deflecting said strand from said jack.

9. The process of claim 1, further comprising the step of:

marking said strand with indicators corresponding to a length of measurement.

10. The process of claim 1, further comprising the step of:

positioning a cap member between a portion of the structure and said pile segment:

trimming said strand following the positioning of said cap member; and tensioning said strand prior to the step of trimming.

11. A process of installing piles for supporting a structure upon the earth comprising:

removing a volume of earth from beneath a portion of the structure so as to expose an end of a first pile segment embedded in the earth;

forming a strand receiver in said first pile segment subsequent to said step of removing the volume of earth;

affixing an end of a strand into said strand receiver such that said end of said strand is fixedly and non-removably secured to said first pile segment;

sliding a second pile segment onto said strand until said second pile segment contacts said first pile segment; and positioning at least one cap member between said structure and said second pile segment.

12. The process of claim 11, said step of forming a strand receiver comprising:

forming a hole in an end of said first pile segment.

13. The process of claim 12, said first pile segment being a timber pile, said step of forming a hole comprising:

drilling a hole of at least two feet into an end of said timber pile.

14. The process of claim 11, said step of affixing comprising the steps of:

placing a adhesive into said hole;

extending said end of said strand into said hole such that said adhesive contacts said strand and said first pile segment; and solidifying said adhesive such that an end of said strand is secured in said hole.

15. The process of claim 11, further comprising the step of:

driving said second pile segment a desired distance into the earth.

16. The process of claim 11, further comprising the step of:

marking said strand with indicators corresponding to a length of measurement.

17. The process of claim 11, further comprising the step of:

trimming said strand following the positioning of said cap member; and tensioning said strand prior to the step of trimming.

* * * * *